United States Patent [19]

Leclaire

[11] Patent Number: 4,691,652

[45] Date of Patent: Sep. 8, 1987

[54] METHOD AND SEWING MACHINE FOR AUTOMATICALLY PROVIDING END OF STITCHING AT A GIVEN DISTANCE FROM THE EDGE OF A PIECE OF FABRIC

[75] Inventor: Charly Leclaire, Dourges, France

[73] Assignee: Prouvost S.A., Nord, France

[21] Appl. No.: 869,915

[22] Filed: Jun. 3, 1986

[30] Foreign Application Priority Data

Jun. 3, 1985 [FR] France ..... 85 08316
Mar. 28, 1986 [FR] France ..... 86 04534

[51] Int. Cl.[4] ..... D05B 19/00; D05B 27/22

[52] U.S. Cl. ..... 112/262.1; 112/315; 112/121.11; 112/272

[58] Field of Search ..... 112/275, 277, 121.11, 112/121.12, 315, 262.1, 272, 2

[56] References Cited

U.S. PATENT DOCUMENTS 4,404,919 9/1983 Martell et al. ..... 112/315 X
4,491,080 1/1985 Hager ..... 112/275
4,495,877 1/1985 Willenbacher ..... 112/272 X
4,545,310 10/1985 Treadwell et al. ..... 112/272 X
4,593,633 6/1986 Leclaire ..... 112/275 X

FOREIGN PATENT DOCUMENTS 0068625 1/1983 European Pat. Off. .
0102524 3/1984 European Pat. Off. .
3236932 4/1984 Fed. Rep. of Germany .

*Primary Examiner*—Peter Nerbun
*Attorney, Agent, or Firm*—Christel, Bean & Linihan

[57] ABSTRACT

The invention provides a method and device for automatically carrying out an end portion of stitching so that this latter is finished at a constant distance from the edge of the material whose passage in front of a fixed point is detected by a sensor (20, 21). In accordance with the invention, during a recording operation, the number of pulses (33) counted on the appearance of the signal delivered by the sensor (20, 21) as well as the final number of pulses are recorded and during reproduction, the number of pulses recorded (33) when the signal appears from the sensor (20, 21) is substituted for the number of pulses (37) counted and the number of pulses thus reinitialized are compared with the final number of pulses (35) for controlling the sewing machine (10) forming complete stitches and possibly a last reduced stitch depending on the results of the comparison.

9 Claims, 10 Drawing Figures

Figures 1A, 1B, 1C, 2A, 2B:
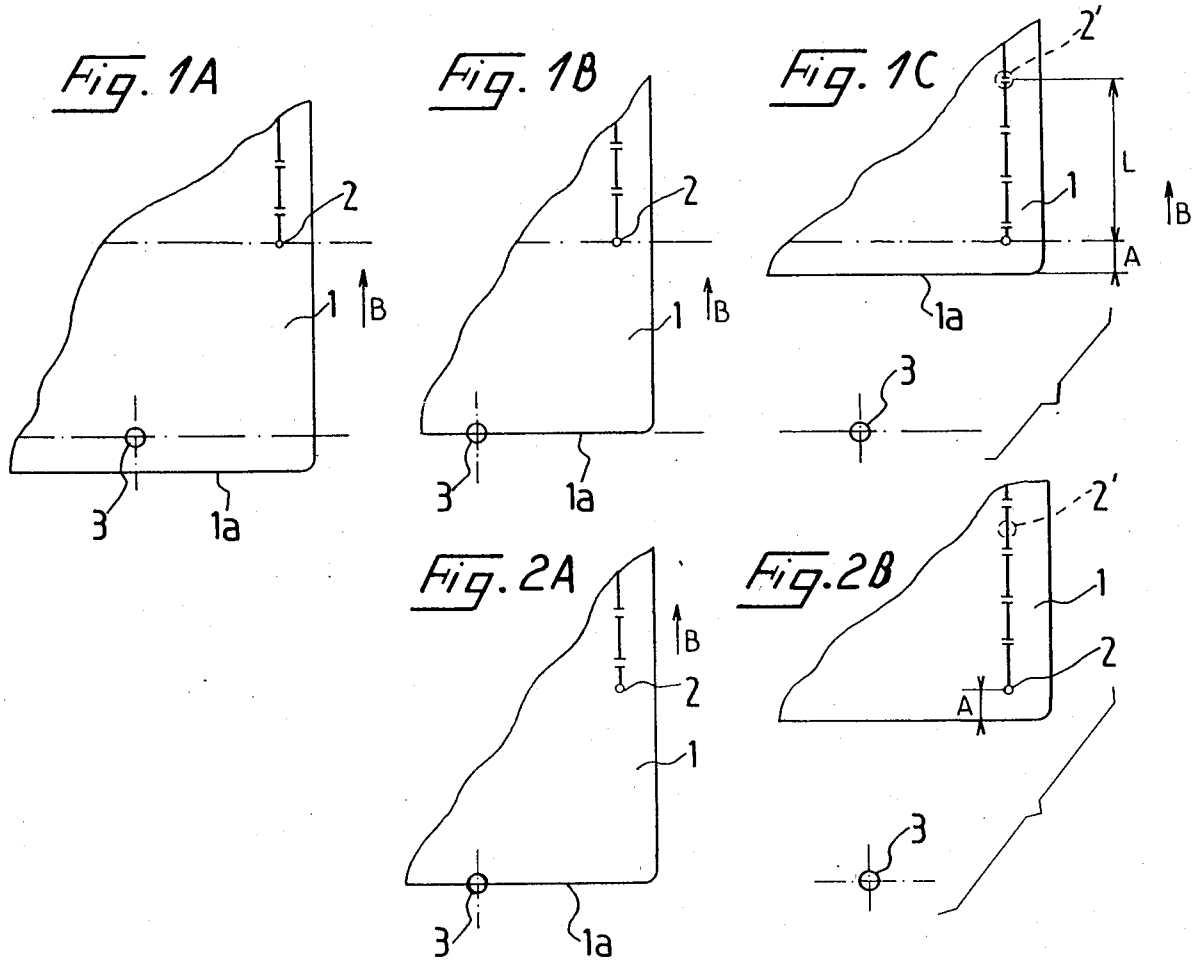

1
1a
2
2'
3
A
L
B 63
66
66b
66a
65
67
64
60
61
62

54
53
50
56
55
52
55a
51

63
64
69
60
61
62
68
67
66b
66a
66

63
66b
66
67
68
64
66a
60
61
62

METHOD AND SEWING MACHINE FOR AUTOMATICALLY PROVIDING END OF STITCHING AT A GIVEN DISTANCE FROM THE EDGE OF A PIECE OF FABRIC

Numerous methods exist for at least partially automating a stitching operation so as to facilitate repetition thereof by the operator charged with carrying it out. One of these methods consists in performing a first operation, taken as model and recording it for then controlling the sewing machine by means of a control unit which uses the data previously recorded during the model forming operation carried out manually. Although this method appears attractive and gives satisfaction in numerous cases in which the stitching is simple and does not need to be carried out with great accuracy, a disparity has very often been noted in the results obtained resulting from factors which cannot be controlled at the time of recording. Thus the position of the last stitch of a seam with respect to the edge of a piece of fabric will depend more particularly on the position of the first stitch of this seam which is determined by the positioning of the work pieces to be sewn under the head of the machine which only the operator can control, on the tendency more or less considerable of the fabric to be deformed under the forces to which it is subjected, and on the accuracy of cutting the pieces of fabric to be assembled together which creates dimensional dispersions from one piece to the other.

It appears then necessary to make corrections to each repetition of the recorded stitching for taking into account these uncontrollable factors. These corrections depend then on detecting the dimension and more generally on the behavior of the pieces to be assembled together by the stitching operation in question.

It is thus theoretically possible to use sensors for collecting information transmitted to the control unit, this latter making the required corrections to the recorded program by means of a complex correction program.

This solution has never found a practical application both flexible and simple in use. It is often preferable to let the operator herself finish manually the recorded stitching operation depending on the disparities that she has discovered and thus directly palliating these disparities. This method however has the drawback of detracting from the "automatic" character of the stitching and implies experience and skill on the part of the operator.

The present invention intends overcoming this problem in a simple way by regarding the length properly speaking of the seam as of secondary importance with respect to the position of the end of the seam opposite, for example a fabric edge. By end of seam should be understood, in addition to the last stitch thereof, any angle or change of direction thereof which is for example to follow the edge of a piece of fabric. This will more particularly be the case for overstitching. It follows therefrom that removing or adding a few stitches in a non terminal zone of the seam matters little for obtaining the desired adjustment.

To reach the desired result, the invention provides a method which consists, whatever the automatic or manual nature of the execution of the greatest part of the seam, in detecting the passage of the edge of the fabric in front of a fixed point determined with respect to the needle and automatically stitching a given length of seam from the detection time. Determination of this length will be achieved by recording a manual model forming operation consisting in storing said length in the form of pulses emitted by a coder controlled by the advance of the fabric under the needle, from the signal of detection of the passage of the edge of the fabric past said point, until the stitching controlled by the operator is stopped (for example by lifting the presser foot).

More precisely, the invention relates to a method for automatically stitching, from a given signal, an end portion of a seam of constant length in one travel direction or in the opposite direction, on a sewing machine provided with a device for adjusting the length of the sewing stitch.

According to the invention, this method consists in storing, by recording a manual operation for stitching at least said end portion, the number of pulses emitted from the appearance of the signal up to the end of the operation, by means of a coding device delivering a pulse for each fraction of the length of a sewing stitch travelled by the fabric in one of the two reverse travel directions and, for reproduction, in controlling, as soon as the signal appears, the stitching of the end part of the seam by means of a central control unit which compares the number of pulses recorded with the number of pulses read, controls the execution of a complete stitch as long as, at the beginning of the stitch, the difference between the number of pulses recorded and the number of pulses read is greater than the number of pulses corresponding to a complete stitch, and controls the device for adjusting the length of the stitch, and the execution of the last reduced stitch when said difference is less than said number of pulses of a complete stitch.

Advantageously, said signal is a detection signal delivered when the edge of the fabric passes in front of at least one fixed point determined with respect to the needle.

It will moreover be advantageous to choose said stitch fraction equal to a quarter of a stitch, or to an eighth of long stitches (case of leather).

In the most frequently met case, the method of the invention will form the end phase of a method for automating a stitching operation, in which, during the recording of a manual model forming operation, counting of said pulses has begun before the appearance of said signal. Thus, on appearance of the signal, during recording, the number of pulses previously counted are stored and, during reproduction, on the appearance of a signal, in place of the number of pulses actually delivered by the coding device is substituted said number of pulses stored during recording.

Advantageously, during recording, a particular distance is selected between said detection point and the needle from several possible distances, said particular distance being selected automatically during reproduction.

With this arrangement, the stitching operation may be adapted to relatively small pieces of fabric for which the distance between the coder and the needle—which is always less than the length to be stitched—must consequently be chosen small.

Similarly, the stitching operation may be adapted to large pieces of fabric for which the stitching speed used is high: the distance between the coder and the needle must consequently be chosen large, so as to take into account the considerable inertia accumulated by the machine and so as to stop it nevertheless at the correct position, after a fairly long braking phase.

The invention also relates to a sewing machine comprising a means for actuating its drive device, a means for adjusting the length of the stitch cooperating with the device driving the fabric in one or two opposite travel directions, a coder coding the stitching length and emitting a pulse for each unitary stitching length corresponding to a fraction of the stitch length, at least one detector detecting the passage of the edge of the fabric in front of a point determined with respect to the needle, control unit whose input is connected to the coder and detector and whose output is connected to the means actuating the motor, and a "recording-reproduction" position switch.

According to the invention, this sewing machine comprises a device for controlling the position of the means for adjusting the length of the stitch connected to the output of the control unit, this latter, when the switch is in its recording position, counting the pulses delivered by the coder and storing the number of pulse counted at the time that the signal delivered by the detector appears and, when the stitch is in its reproduction position, counting the pulses delivered by the coder, substituting the value of the number counted by said stored number on the appearance of the signal from the detector, continuing the counting initialized from this new number and continuing to control the drive device as long as, at the beginning of each stitch, the difference between the number of pulses of the end of stitching such as it is recorded and the number of pulses read is greater than the number of pulses corresponding to a complete stitch, and controlling the last sewing stitch as well as controlling the position of the means adjusting the length of the stitch when said difference is less than the number of pulses corresponding to a whole stitch.

In some cases, it may be advantageous to be able to carry out stitching on a piece of fabric by causing this latter to travel under the needle in a first travel direction, then in a second travel direction opposite the first. Thus, for pieces of fabric of great length, such as webbing, such a possibility avoids having to turn the piece of fabric round by 180° so as to make; in the same operation, two successive rows of stitches parallel to each other: the second row of stitching will be formed simply by reversing the travel direction of the piece of material.

For this reason, and in a preferred embodiment of the sewing machine of the invention, it comprises two detectors detecting the passage of the edge of the fabric in front of two points situated on each side of the needle relatively to the travel direction of the material.

Thus it is possible to detect the passage of a first edge of the fabric when it travels in the first direction, by means of the first detector, but it is also possible to detect the passage of a second edge of the fabric opposite the first one when this latter travels in the other direction, by means of the second detector.

Preferably, the detectors are disposed symmetrically with respect to a plane perpendicular to the detection of travel of the fabric and passing through the needle.

Moreover, and so that the operator may adapt the distance between the detection point and the needle as a function more particularly of the size of the pieces of fabric in the way explained above, the sewing machine may comprise at least two detectors detecting the passage of the edge of the fabric situated on the same side of the needle relatively to the travel direction of the fabric, but at different distances with respect to the needle.

The invention will be better understood from the following description given by way of example which is purely indicative and in no wise limitative showing the advantages and secondary characteristics.

Reference will be made to the accompanying drawings in which:

FIGS. 1A, 1B and 1C illustrate schematically the recording of end of stitching using the method of the invention.

Figure 3:
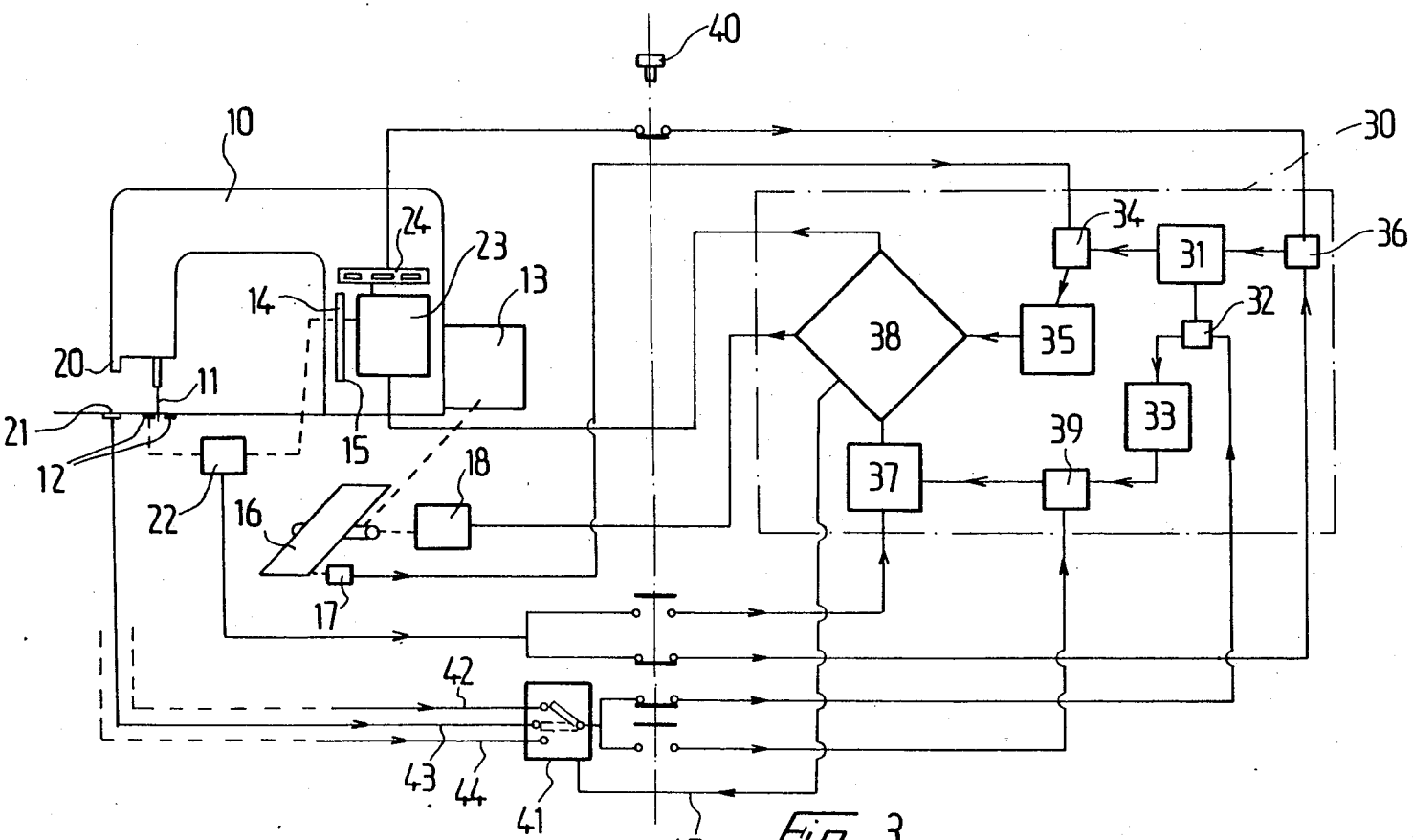
Figures 4, 5A, 5B, 5C:
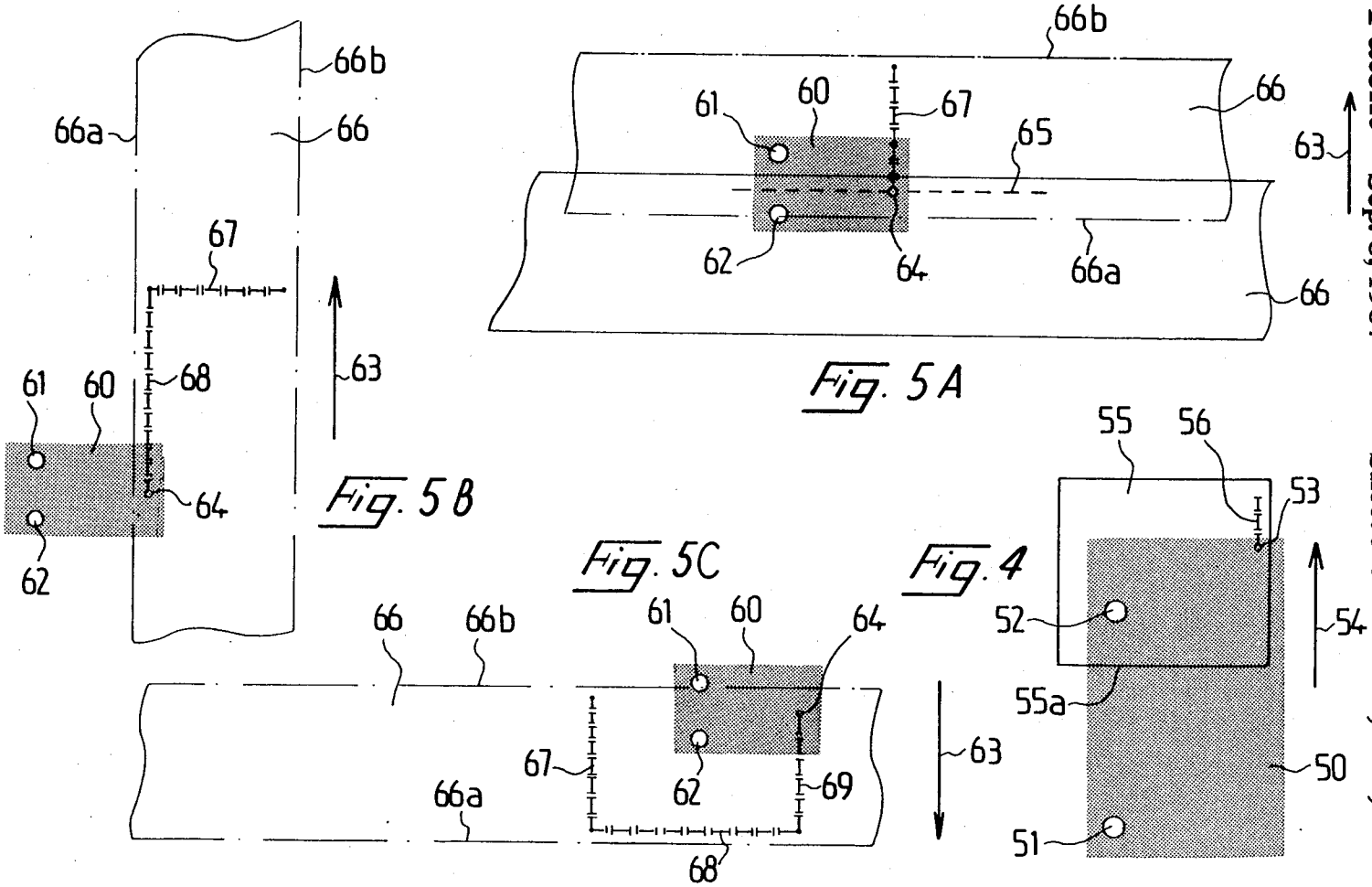

FIGS. 2A, and 2B illustrate schematically the reproduction of the stitching phase recorded as in the preceding Figures, FIG. 3 is a diagram of a sewing machine for implementing the method of the invention, FIG. 4 shows schematically the use of a sewing machine of the invention, comprising two edge detectors situated on the same side of the needle, and FIGS. 5*a*, 5*b* and 5*c* show schematically, the use of a sewing machine of the invention, comprising two edge detectors situated on each side of the needle.

In FIGS. 1A to 1C has been shown a piece of material or fabric 1 disposed under the head of a sewing machine of which only the needle 2 has been shown. This piece of fabric, which is being stitched, has an edge 1A at a distance A (FIG. 1C) from which the stitching is to be stopped. An edge detector 3 is disposed on the frame of the machine at a given point with respect to the needle 2.

The passage of the edge of the piece of fabric may be detected by means of an opto-electric sensor, provided that the piece of material is transparent to this radiation: the variation of the rate of absorption of the radiation caused by the change of thickness of the fabric will then be detected.

On the other hand a thickness sensor may be used detecting directly the variation of thickness in line with the edge of the piece of fabric. The position of the edge detector 3 with respect to the needle is not critical provided that, the travel direction of the fabric being shown by the arrow b, the edge 1*a* meets it before passing under the needle 2, and this sufficiently soon so that a few stitches may still be made before reaching the reference A. The choice of its positioning will however be influenced by the profile of the edge 1*a* and the space available in the vicinity of the stitching head.

When edge 1*a* passes over the detector 3, a signal is produced from which a pulse counter is initiated counting the pulses delivered by a coder not shown in the Figures. This coder delivers a pulse per elementary stitching length which is a fraction of the length of the stitch.

Thus, during recording of the stitching operation, initiation of the counter is controlled when the piece of fabric is in its position shown in FIG. 1B. the operator continues the operation until the configuration shown in FIG. 1C is reached. In the case illustrated by the drawing she has stitched three and a half stitches. Assuming that the coder emits a pulse every quarter of a stitch, the counter has recorded 14 pulses from the signal emitted by detector 3 until the stitching is stopped at distance A from the edge, corresponding to an end stitching length L (2' being, in FIG. 1C, the position of the fabric where the counter was initiated).

The operator then takes the next piece of fabric and repeats the stitching operation which has just been carried out, either manually or which is more generally the case, assisted by automation resulting also from a recording of the non terminal part of the stitching, as will be seen further on. At the time (FIG. 2A) when detector 3 delivers its signal, the needle is in any position of its cycle for making a stitch. This is due to several causes: dispersion in the dimensions of the piece of fabric due to cutting, starting up of the stitching operation at a different point from which the model forming operation was started up, distortion of the fabric. The coder delivers, as during recording, a pulse every quarter of a stitch and the number of pulses delivered is constantly compared with the number of pulses recorded. At the same time the control of the machine, if this was not already done at the beginning of stitching, is taken out of the hands of the operator and is taken over by a control unit, of the microprocessor or robot type, which controls the execution of the last stitches as a function of the previous recording and of the position of the needle in the cycle for making a stitch, which it knows constantly. Thus, the control unit allows the stitch during which the edge detector 3 delivered its signal to be finished and each of the additional complete stitches to be executed as long as the difference between the number of pulses recorded by the counter and the number of pulses delivered by the coder, at the beginning of each cycle for making a stitch, is greater than or equal to the number of pulses delivered during the execution of a stitch. When this difference becomes less, the control unit actuates a device for adjusting the length of the stitch for reducing it to a fraction corresponding to the ratio between the value of this difference and the number of pulses per stitch.

As can be seen in FIGS. 2*a* and 2*b*, the edge detector 3 having delivered a signal in the middle of a stitch cycle, the control unit ascertains that at the end of this stitch two pulses have been delivered which, substracted from 14, allow a complete additional stitch to be executed until it is ascertained that the difference is zero at the end of the third complete stitch made after the signal from detector 3.

In the case where the automation of the end of stitching operation is integrated in a method for automating the whole of the stitching, the coder is used from the beginning of the operation, not only for the recording phase but also for the reproduction phase, and at the time when the signal is delivered by detector 3, a certain number of pulses has already been counted. Automation at the end of stitching then consists, in the recording phase, in storing the number of pulses already counted on the appearance of the signal from detector 3 while then continuing counting of the pulses corresponding to the last stitches. During reproduction, with the control unit being in charge of the whole of the stitching, it drives in a known way the different drive means of the machine as a function of the pulses counted during recording and whose number has been stored whenever a modification of the control of the stitching operation occurred. Thus, for example, at the time of the change of stitching speed, on the one hand, the order number of the pulse concomitant on this change of speed and, on the other hand, data relative to the new speed acquired are stored so that, on reproduction, the control unit, after ascertaining the identity of the number of pulses read with that recorded, may give to the machine the new speed value.

During reproduction, when the signal appears from detector 3, the control unit substitutes for the number of pulses read the number of pulses stored during the recording phase and then makes comparisons and gives orders for executing stitches such as described above from the substituted number. With this arrangement, the end of stitching may be carried out so as to keep the distance A constant for all the automatic stitching operations. Thus, in fact, all the factors uncontrollable in each operation are overcome (positioning of the piece of fabric, behavior of the fabric, cutting defects . . . ).

In FIG. 4, the sewing machine 50 comprises two edge detectors 51, 52 disposed on the same side of the needle 53 relatively to the travel direction of the fabric shown by arrow 54, but at different distances with respect to needle 53, for example respectively at 30 mm and at 10 mm therefrom.

In this Figure a piece of fabric 55 of small size is shown, on which stitching 56 is being formed. It will be noted that the edge detector 51 the furthest away from the needle is not covered by the piece of fabric 55 and is therefore not able to detect the passage of its edge 55*a*. Advantageously, the other edge detector 52 situated closer to needle 53 will still be covered by the piece of fabric 55 when the stitching approaches edge 55*a*, and it may then detect the passage of this latter at the right moment.

The sewing machine 60 shown symbolically in FIGS. 5A, 5B and 5C comprises two edge detectors 61, 62 disposed symmetrically with respect to a plane 65 perpendicular to the travel direction 64 of the fabric and passing through the needle 64.

Webbing or a band 66 of great length occupies a stitching start position as shown with continuous lines in FIG. 5A, which is perpendicular to the direction of travel 63 of the fabric. By moving to the position shown with a dash dot line in FIG. 5A, a first line of stitching 67 is formed perpendicular to the edges of the webbing: the end of stitching is detected by the passage of edge 66*a* of the webbing 66 in line with the edge detector 62.

By turning the webbing zone to be stitched by 90° in a clockwise direction, from the first line of stitching 67 a second line of stitching 68 is formed parallel to the edges 66*a*, 66*b* of the webbing 66. (FIG. 5B).

Then, by rotating the webbing through 90° in an anticlockwise direction, so as to bring it back to its initial position, from the second line of stitching 68 a third line of stitching 69 is formed parallel to the first one 67 (FIG. 5C). The direction of travel of the fabric is then opposite that of FIG. 5. Towards the end of this operation, the other edge detector 61 is activated for detecting the passage of the other edge 66*b* of the webbing 66.

The presence of the two edge detectors 61, 62 thus avoids having to turn the webbing through 180° which in practice is unthinkable.

The fourth line of stitching parallel to the second line of stitching 68 may be formed in the same way as this latter (5B), but in a reverse travel direction of the fabric.

FIG. 3 illustrates schematically a sewing machine for implementing the method of the invention.

This machine 10 comprises in a way known per se a needle 11, claws for advancing the fabric 12, both connected to a drive means 13 by a known mechanism which is not described here. Also in a way known per se, the machine comprises a means 14 for adjusting the length of the stitching to be made which acts on the transmission mechanism connecting the motor 13 to the drive claws 12. This means 14 consists of a lever urged towards its largest stitch position which cooperates with a manually adjustable stop and against which the lever is urged. By moving the stop (for example downwards along a fixed slide 15) the rest position of the lever and so the length of the stitch is modified while leaving the possibility of manually operating the lever below this stop for momentarily reducing this length. A control pedal 16 is associated with the motor 13 and cooperates with a detector 17 controlling stopping of the machine. A device 18 allows the automatic control of the position of the pedal, so the automatic control of the operation of the machine.

Several detectors detecting the passage of the edge of the fabric are provided, one of which is represented by a radiation transmitter 20 and a receiver 21 between which passes the fabric filtering to a greater or lesser degree the intensity of the radiation depending on its thickness or texture.

The coder delivering the above mentioned pulses has been shown symbolically at 22. It is also associated with the kinematic chain driving the claws. It will for example deliver four pulses per stitch, whatever the selected length of stitch. Without departing from the scope of the invention, a coded wheel may be used which rolls without sliding over the fabric. In this case, the pulses delivered will be delivered for each elementary distance travelled (for example 5/10ths of a millimeter) and for using these pulses they will be converted to the corresponding stitch fraction which will be varied depending on the length of the chosen stitch. This conversion may be made by the control unit by means of an appropriate computing program taking into account the initial adjustments of the machine.

The machine also comprises, associated with the means 14 for adjusting the stitch length, a device 23 controlling a fraction of this length. This device may be formed by pneumatic actuators which actuate, either by manual control or in response to an order from the control unit, the lever of means 14 for moving it into a position for carrying out the chosen stitch fraction. Thus, when the stitch fraction corresponding to a pulse is a quarter of a stitch, the device 23 comprises three actuators which, respectively, reduce the length of the stitch by a quarter, by a half or by three quarters of its value. The manual control of these actuators is shown symbolically at 24. It will be noted in this connection that, with the coder 22 still delivering four pulses per stitch, actuation of the manual control 24 results in sending to the control unit a signal corresponding to the subtraction of one, two or three pulses depending on whether the stitch is reduced by a quarter, by a half or by three quarters. It should also be noted that device 23, whether it is actuated by control 24 or by the control unit, only allows a single stitch of reduced length to be formed, the last stitch in the stitching operation.

The control unit of the machine, microprocessor or robot 30, is shown very schematically in FIG. 3. In this diagram have not been shown all the arrangements for recording and reproducing the whole of stitching operation and the functional use of the parameters detected and recorded such as the position of the pedal 16, the times during which the stitching is interrupted, the positions (raised or lowered) of the presser foot . . .

The control unit will be described herebelow in relation to the functions which it provides during the recording and reproduction phases.

With a switch button 40 the recording phase (that shown) and the reproduction phase of the operation of the machine may be selected.

The different edge detectors are connected selectively to the control unit 30, through an automatic switch shown symbolically at 41, to which the edge detectors are connected by connection lines 42 to 44. The automatic switch is connected to control unit 30, through the switching button 40, for transmitting the detection signal from the selected one of the edge detectors; it is controlled either manually, or automatically by the control unit 30, and is connected for this purpose thereto by a control line 45.

During recording of a stitching operation, the operator selects one of the available edge detectors, depending more particularly on the size of the piece of material to be stitched, by actuating the automatic switch 41. The pulses delivered by coder 22 are counted in a counter 31. On the appearance of the signal delivered by the selected fabric edge detector, a device 32 transfers the value from this counter 31 into a memory 33. The end of stitching is detected by means 17 which transmits a direction to device 34 of the central control unit allowing the total number of pulses counted to be transferred into memory 35. If, during recording, the operator has used the device 14 for adjusting the length of the last stitch by means of control 24 and device 23, a signal was transmitted to the subtractor 36 for subtracting one, two or three pulses from the four received from device 22 during the formation of the last stitch.

In the reproduction phase, only the edge detector previously selected by the operator is then activated by the control unit 30, more precisely by a computing element 38. Coder 22 transmits the pulses which it delivers to counter 37. The computing element 38 compares more particularly the number of pulses received by counter 37 with the values stored so as to control, at the output, the position of pedal 16 through device 18. When the signal delivered by detector 20, 21, appears, the reference values stored in memory 33 is transferred by device 39 to counter 37 and is substituted for the value which it contains.

The computing element 38 then proceeds with the constant comparison of the reinitialized value of counter 37 and of memory 35 and, at the output, controls device 18 as long as the difference between these values, at the beginning of each stitch—which it knows permanently moreover—is greater than or equal to four pulses (in the example considered) and device 23 for selecting and forming the last stitch of reducing length, if this difference is less than four.

In the foregoing description, it has always been a question of a given signal which occurs in random fashion, on the one hand, during recording and on the other during reproduction, with respect to a stitch forming cycle.

Stitching exists in which the given signal is not dependent on a detector but is quite simply the signal for starting the stitching or the stitching portion in question. Now, stitching always starts up at the beginning of a stitch forming cycle. Therefore, recording begins at the beginning of the stitch and the repetition can only be initiated at the beginning of a stitch. It follows that the calculation of the length of the last stitch for each repetition is simplified since it will always be identical to the one recorded. In the case of pieces of material of very small dimensions (such as labels in the middle of a piece of material) this method is simpler to use than the use of an edge detector. It is then sufficient to choose, as signal for beginning recording and for initiating reproduction, the signal delivered at the beginning of each stitching operation for example by lowering the presser foot for example. Thus, stitching may be readily reproduced whose last stitch is not a complete stitch.

The invention finds an interesting application in the field of ready to wear clothing, furnishing and leather industries.

I claim:

1. A method for automatically carrying out, from a given signal, an end stitching portion of constant length (L) in one travel direction or in the opposite direction, on a sewing machine (10) having a device (14) for adjusting the length of the stitch, characterized in that it consists in storing, by recording a manual operation for forming at least said end portion (L), the number of pulses delivered, from the appearance of said signal until the end of the operation, by means of a coding device (22) delivering a pulse per fraction of the length of the stitch travelled by the fabric in one of the two opposite travel directions and, during reproduction, controlling from the appearance of said signal the execution of the end part (L) of said stitching by means of a central control unit (30) which compares the number of pulses recorded with the number of pulses read from said coding device (22) during reproduction, orders for execution of a complete stitch as long as, at the beginning of the stitch, the difference between the number of pulses recorded and the number of pulses read is greater than the number of pulses corresponding to a complete stitch, and controls the device for adjusting the length of a stitch and the execution of the last reduced stitch when said difference is less than said number of pulses of a whole stitch.

2. The method according to claim 1, characterized in that said signal is a signal of detection of the passage of the edge of the fabric in front of at least one fixed point determined with respect to the needle (11).

3. The method according to claim 1, characterized in that said fraction is a quarter of a stitch.

4. The method according to claim 1, forming the end phase of a method of automation of a stitching operation, in which, during the recording of a model forming manual operation counting of said pulses is begun before the appearance of said signal, characterized in that, on appearance of the signal, during recording, the number of pulses previously counted are recorded and in that, during reproduction, on the appearance of the signal, said number of pulses stored during recording is substituted for the number of pulses actually delivered by the coding device.

5. The method according to claim 2, characterized in that, during recording, a particular distance is selected between said detection point (3) and the needle (11) among several possible distances, said particular distance being selected automatically during reproduction.

6. A sewing machine comprising:

a means (16) for actuating the drive device (13) of the sewing machine, a means (14) for adjusting the length of the stitch cooperating with the device (12) for moving the fabric in one of two opposite travel directions, a coder (22) of the stitching length delivering a pulse for each unitary stitching length corresponding to a fraction of the stitch length, at least one detector (20, 21) detecting the passage of the fabric in front of a given point with respect to the needle (11), a control unit (30) connected at its input to said coder (22) and said detector (20, 21) and at its output to the means (16) for actuating the motor, a recording-reproduction position switch (40), a device (23) for controlling the position of the means (14) for adjusting the length of the stitch connected to the output of said control unit (30), when the switch (40) is in its recording position, counting the pulses delivered by the coder (22) and storing the number of pulses counted at the time when the signal delivered by said detector (20, 21) appears and, when the switch (40) is in its reproduction position:

counting the pulses delivered by the coder (22), substituting the value of the number counted by said stored number on the appearance of the signal from the detector (20, 21), continuing the counting initialized from this new number and continuing controlling the drive device (13), as long as, at the beginning of each stitch, the difference between the number of pulses at the end of stitching such as it is recorded, and the number of pulses read is greater than the number of pulses corresponding to a whole stitch, and controlling the last stitch and the position of the means (14) for adjusting the length of the stitch when said difference is less than the number of pulses corresponding to a whole stitch.

7. The sewing machine according to claim 6, characterized in that it comprises two detectors (61, 62) detecting the passage of the edge of the material in front of two points situated on each side of the needle (64) relative to the travel direction of the material.

8. The sewing machine according to claim 7, characterized in that said detectors (61, 62) are disposed symmetrically with respect to a plane (65) perpendicular to the travel direction of the material (63) and passing through the needle (64).

9. The sewing machine according to claim 6, characterized in that in comprises at least two detectors (51, 52) detecting the edge of the materials situated on the same side of the needle (53) relative to the travel direction (54) of the material, but at different distances with respect to the needle (53).

* * * * *